US005921370A

United States Patent [19]

Plesh, Sr.

[11] Patent Number: 5,921,370

[45] Date of Patent: Jul. 13, 1999

[54] MODULAR INSERT FOR COOLING BED PLATE TRANSFER GRID

[76] Inventor: Ronald L. Plesh, Sr., 31 Hemlock Hill, Orchard Park, N.Y. 14127

[21] Appl. No.: 08/869,797

[22] Filed: Jun. 5, 1997

[51] Int. Cl.[6] ..... B65G 13/12

[52] U.S. Cl. ..... 193/35 R; 193/35 SS; 266/277

[58] Field of Search ..... 193/35 R, 35 SS, 193/35 J, 35 C, 37; 198/721, 615; 266/274, 279, 277

[56] References Cited

U.S. PATENT DOCUMENTS

| | | | |
|---|---|---|---|
| 4,627,526 | 12/1986 | Masciarelli | 193/35 SS |
| 5,042,633 | 8/1991 | Jenkner | 193/35 SS |
| 5,265,711 | 11/1993 | Plesh, Sr. . | |
| 5,301,785 | 4/1994 | Plesh, Sr. . | |
| 5,390,775 | 2/1995 | Herrick et al. | 193/35 R |
| 5,472,179 | 12/1995 | Wendt et al. . | |

*Primary Examiner*—Joseph E. Valenza
*Assistant Examiner*—Mark Deuble
*Attorney, Agent, or Firm*—James C. Simmons

[57] ABSTRACT

A cooling bed plate transfer grid insert which is height adjustable independently of its mounting to the grid. The insert has an outer frame which is clampable to the grid and an inner frame supporting a roller and which is clampable to the outer frame and height adjustable relative to the outer frame so that the mounting of the outer frame to the grid need not be disturbed when adjusting the height of the roller or when replacing the inner frame and roller assembly for repair of the insert. The inner frame is thus easily and inexpensively replaceable without the necessity of replacing the outer frame. The replaceable inner frame includes stationary bearings for the rotating roller shaft to provide improvement in wear life of perhaps about 200 per cent. Springs are provided to allow the roller to flexibly move downwardly under load of plates being moved thereover so that each of the rollers underlying a plate bears its share of the load, but the rollers are biased to the desired unloaded height. A ramp is provided on the inner frame for deflecting the plates being transferred onto the roller and thereby eliminating or reducing "catch points" which may cause thin plates to bend. The end portions of the inserts have mating tongues and grooves allowing successive end-to-end placement of the inserts.

20 Claims, 4 Drawing Sheets

MODULAR INSERT FOR COOLING BED PLATE TRANSFER GRID

The present invention relates generally to transfer grids for ferrous and non-ferrous metal plates and the like. More particularly, the present invention relates to inserts clamped thereto and supporting rollers which engage plates being transferred so that friction between the plates and the grid is avoided or reduced. The present invention also relates generally to methods using such transfer grids for cooling such plates.

My prior U.S. Pat. Nos. 5,265,711 and 5,301,785, which are hereby incorporated herein by reference, disclose the clamping of roller supporting inserts in transfer grid pockets for moving of the plates over the rollers. The roller is rotatably mounted by means of a bushing on an axle the ends of which are secured in apertures in plates. Members forward and aft of the roller and sandwiched between and welded to the plates form a frame in which the roller is mounted. Clamping of the insert to the grid is achieved by means of setscrews and brackets which engage the upper and under surfaces respectively of the grid, and the setscrews also serve for height adjustment. This insert has worked well. However, the insert must be partially unclamped so that its height can be adjusted.

U.S. Pat. No. 5,472,179 suggests a cooling bed plate transfer grid insert which comprises a cast housing which has front and rear end flange portions which seat on successive cross members of the transfer grid and which is clamped by means of J-bolts to these cross members. A roller structure is mounted in a central slot in the housing. The roller is mounted on the central journal portion of a pin, and the pin further includes rectangular end portions slidably received in vertical slots defined by the housing at opposite sides of the roller. A pair of adjustment screws threadedly engage the end portions of the pin and engage the bottom walls of the side slots so that joint rotation of the screws raises and lowers the roller in a translatory manner. Such an arrangement is not considered to be sufficiently reliable under the rugged conditions encountered in moving hot heavy plates over cooling beds. When plates are being picked up by magnets, as is conventional practice when a problem is experienced in moving the plates over the grid, the roller structure as disclosed in this patent may undesirably be removed from the insert housing by a magnet.

Moreover, if the inserts underlying a plate are not all adjusted exactly to the same roller height, some rollers may bear greater shares of the load with the result that the plates may be unduly stressed with possible damage thereto.

Accordingly, it is an object of the present invention to provide an insert which is rugged and reliable and allows height to be adjusted independently of the clamping of the insert to the grid.

It is a further object of the present invention to provide an insert which is not subject to removal of the roller by a magnet.

It is another object of the present invention to provide an insert which has long bearing life.

It is yet another object of the present invention to provide an insert which is easily, quickly, and inexpensively repairable.

It is yet another object of the present invention to eliminate or reduce catch points of thin plates being transferred, which if caught on the catch points may tend to bend in the middle.

It is still another object of the present invention to allow successive placement of inserts end-to-end.

It is a further object of the present invention to provide flexibility vertically of the rollers so that each roller underlying a plate may bear its share of the load.

In order to provide a rugged and reliable insert which is height adjustable independently of the clamping thereof to a cooling bed plate transfer grid, in accordance with the present invention the insert has a first frame which is clampable to the transfer grid and a second frame supporting a roller and which is clampable to the first frame and height adjustable relative to the first frame.

In order to eliminate or reduce "catch points" of thin plates on a cooling bed plate transfer grid, in accordance with the present invention a ramp is provided on the frame for deflecting the plates onto the roller.

In order that cooling bed plate transfer grid inserts may be placed successively end-to-end, in accordance with the present invention the end portions of the inserts have mating tongues and grooves allowing end portions of two successive inserts to overlie the same transfer grid member.

In order to provide flexibility vertically of the rollers so that each roller underlying a plate may bear its share of the load, in accordance with the present invention a spring means is provided to allow downward movement of the respective roller while biasing the roller to the desired unloaded roller height.

The above and other objects, features, and advantages of the present invention will be apparent in the following detailed description of the preferred embodiment thereof when read in conjunction with the accompanying drawings wherein the same reference numerals denote the same or similar parts throughout the several views.

DETAILED DESCRIPTION OF THE PREFERRED EMBODIMENT

Figures 1, 2, 3, 4:
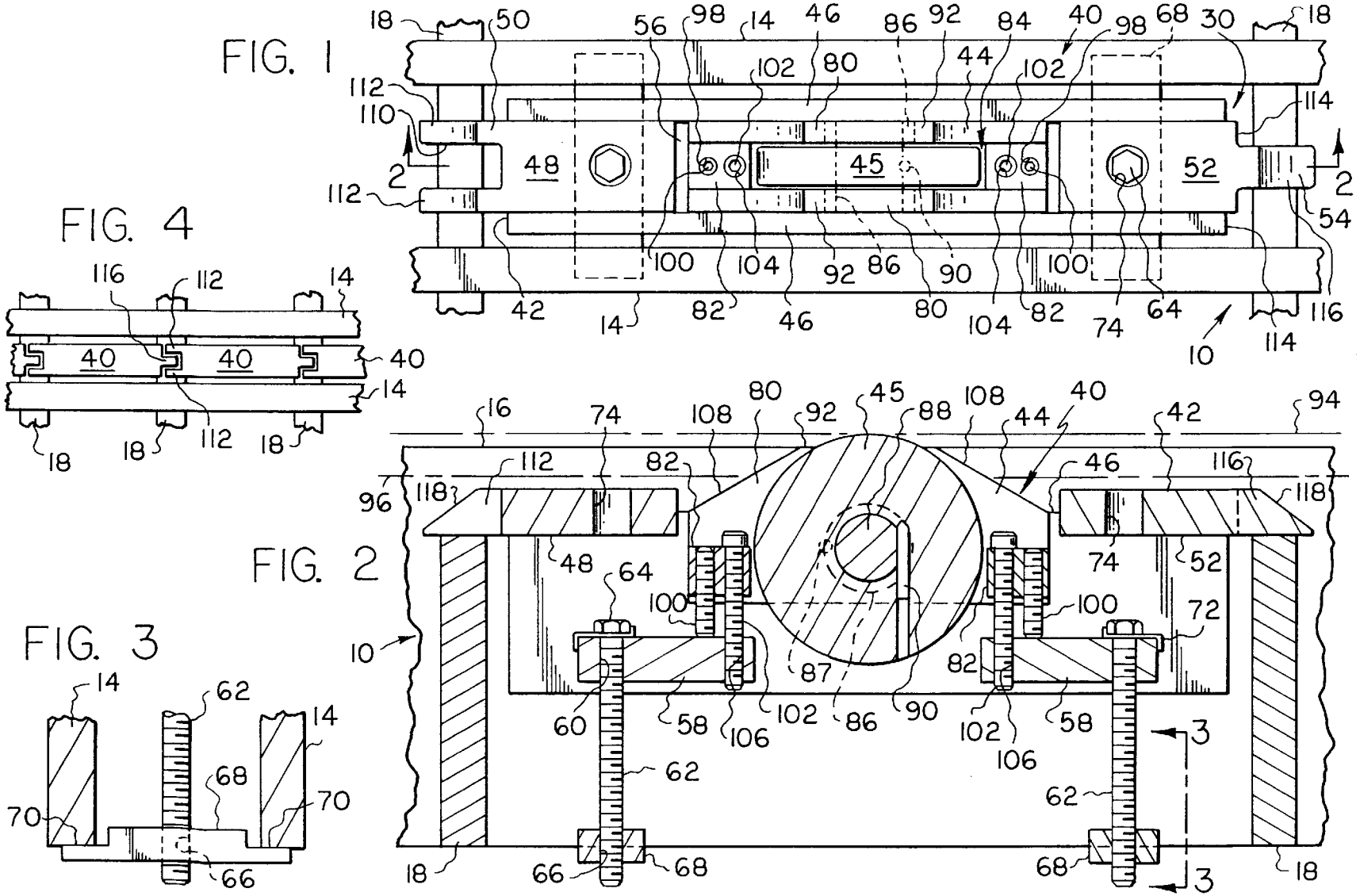
FIG. 1 is a plan view of an insert which embodies the present invention, mounted to a cooling bed plate transfer grid.
FIG. 2 is a sectional view thereof taken along lines 2—2 of FIG. 1.
FIG. 3 is a detail sectional view taken along lines 3—3 of FIG. 2.
FIG. 4 is a schematic view illustrating a plurality of the insert placed successively in an end-to-end relation on the grid.

Referring to the drawings, there is illustrated generally at 10 a portion of a grid which, with a plurality of like grids, forms a cooling bed for transferring hot ferrous and non-ferrous metal plates and for cooling them by air circulation and the passage of time as they are moved therealong such as by chains or the like. The transfer grid 10 is cast or fabricated as a weldment or otherwise suitably constructed in a single piece of iron or other suitable material and includes a plurality of first parallel portions or members 14 extending in the direction of travel of the plates and providing upper surfaces 16 which, without the inserts described hereinafter, frictionally engage the metal plates for sliding movement of the metal plates therealong. The members 14 are supportedly joined by cross-portions or cross-members 18 which extend at right angles thereto. The members 14 project above the cross-members 18 a distance of perhaps about ½ to 2 inches to provide the supporting surfaces 16 receiving the plates and along which the plates are conveyed from left to right, as seen in FIGS. 1 and 2. This distance could be reduced by wear to zero. The members 14 and 18 may be (but are not required to be) slightly tapered so as to have a greater thickness at the bottom surfaces thereof. The space bounded by a pair of members 14 and a pair of cross-members 18, which is generally rectangular, defines a pocket 30. The transfer grid 10 as so far described is of a type which is conventional in the art and is described in greater detail in my aforesaid patents and will therefore not be described in greater detail herein.

The frictional sliding movement of the metal plates over the surfaces 16 of the members 14 causes wear thereof with the result that frequent replacement of the entire grid has been typically required at high cost. In addition, the under surface, illustrated at 94, of the plates may undesirably be marred as they are conveyed along the grid members 14. In my aforesaid patents, a plurality of inserts, providing rollers, are disclosed as being mounted in the pockets in order to reduce such wear and marring.

In order to allow adjustment of height independently of clamping to the grid 10, in accordance with the present invention an insert, shown generally at 40, is provided which has a first or outer frame 42 which is clamped, as described in greater detail hereinafter, to the grid 10. The insert 40 also has a second or inner frame 44 which supports a roller 45 and which is clamped to the first frame, as described in greater detail hereinafter. The second frame 44 is height adjustable relative to the first frame 42 and thus independently of the mounting of the insert to the grid, as described in greater detail hereinafter. This allows the second frame 44 to be removed and replaced without disturbing the mounting of the insert to the grid for easy and quick repair of this modular insert 40 inexpensively. The outer frame 42 protectively buffers the inner frame 44 and its roller 45 from side damage.

The outer frame 42 comprises a pair of elongate parallel plates 46 which are oriented parallel to the grid members 14 when the insert 40 is installed in the pocket 30. Disposed between a pair of end portions of the plates 46 and welded or otherwise suitably attached thereto is a plate 48 which has an end portion 50 which extends longitudinally beyond the corresponding ends of plates 46 and rests on top of the corresponding grid cross-member 18. Disposed between a pair of end portions of the plates 46 at the other end of the insert 40 and welded or otherwise suitably attached thereto is another plate 52 which has an end portion 54 which extends longitudinally beyond the corresponding ends of plates 46 and rests on top of the corresponding grid cross-member 18. Plates 48 and 52 are raised slightly above the upper edges of plates 46 so that the plates 94 being transferred do not "catch" on plates 46. The plates 46, 48, and 52 thus define a rectangular pocket 56.

Disposed in an horizontal orientation generally below plates 48 and 52 and extending cross-wise between and welded or otherwise suitably attached to plates 46 are a pair of plates 58 respectively. Each plate 58 extends longitudinally of the insert outwardly short of the respective ends of members 46 and inwardly beyond members 48 and 52 respectively. An aperture 60 is provided vertically through the longitudinally outer edge portion of each plate 58 at a point which is generally mid-way between the plates 46. A hex head bolt 62 is received in the aperture 60 with the head 64 upwardly thereof. The lower end portion of the bolt 62 is threadedly received in a threaded aperture 66 which is centrally disposed between the ends of a bar 68. The bar 68 has a length to rotate by manipulation of the bolt 62 so as to underlie both adjacent grid members 14. The end portions of the clamp bar 68 are stepped as by notches 70 to prevent the clamp bar 68 from working loose. A locking tab washer 72 is provided for each hex bolt 62 to prevent it from working loose. Apertures 74 are provided in plates 48 and 52 directly above bolts 62 to allow insertion of a suitable socket wrench or the like so that the socket reaches the hex heads 64 for suitably manipulating the bolts 62 for clamping the outer or stationary frame 42 to the grid.

The inner frame 44 includes a pair of parallel members 80 which extend parallel and alongside outer frame members 46 within the pocket 56. A pair of forward and aft cross members 82 are welded or otherwise suitably attached to the members 80 to define therewith an interior pocket or socket, illustrated at 84, in which the roller 45 is received.

Since the inner frame 44 may be inexpensively formed of thin plates which may also advantageously provide a spring action to the roller 45, the roller 45 is advantageously permanently mounted to the inner frame 44. This allows a more rugged mounting of the roller 45 for longer bearing life with the insert being repairable by replacement, inexpensively, easily, and quickly, of the entire inner frame 44. Thus, a pair of bearings 86 are suitably mounted in the frame members 80 respectively and prevented from rotation by pins 87. The roller 45 is suitably mounted, for rotation within the interior frame pocket 84, on a shaft 88 and secured against rotation thereon by pin 90. The ends of the shaft 88 are suitably rotatably mounted in bearings 86 respectively in the plates 80 thereby affording greater bearing surface area for greater bearing life (by as much as perhaps about 200 per cent) so as to thereby advantageously reduce the frequency with which the inner frame 44 has to be replaced. Alternatively, the roller 45 may have a bearing for rotation about a fixed (not rotatable) shaft.

The inner frame 44 is shown with the upper surfaces 92 of members 80 at a desired height which is generally level with the top surfaces 16 of the grate when the grate is new. As the grate wears, its top surface gradually lowers so that it may be at the level illustrated at 96. It is thus considered desirable that the roller height be adjustable to the grate height. In order that the inner frame 44 be height adjustable relative to the outer frame 42, each of the members 82 has a vertical aperture 98 in which is threadedly received a set screw 100 the lower end of which rests on the respective outer frame member 58. Thus, by manipulating set screws 100, the height of the inner frame 44 is adjustable without disturbing the mounting of the outer frame 42 to the grate 10. After suitable height adjustment has been achieved, the inner frame 44 is securable to the outer frame 42 by an allen or hex screw 102 which is received in a vertical aperture, illustrated at 104, in each of the inner frame members 82 and threadedly received in a threaded aperture, illustrated at 106, in the respective outer frame member 58. Thus, the height adjustable inner frame 44 with the accompanying roller 45 may be advantageously clamped down to the outer frame 42 so that it is not lifted by magnets which are sometimes used to manipulate the plates 94 being transferred.

The plates 80 are suitably formed to have upper surfaces 108 which are inclined upwardly from their forward and rear edges respectively to the central uppermost surface 92 to provide "contact ramps" for advantageously deflecting the plates 94 being transferred onto the roller 45 without high shock being applied to the roller 45 and the roller bearings 86. These contact ramps 108 also reduce the exposure of thin plates 94 encountering "catch points" on the insert 40 and bending as they are being moved along the grid 10. The roller 45 is raised to a height above surface 92, and the inner frame 44 is also desirably height adjusted so that the lower-most points or bottoms of the contact ramps 108 are below the upper surfaces of outer frame members 48 and 52.

Member 48 on one end of the outer frame 42 has a longitudinally-extending centrally disposed cut-out or groove, illustrated at 110, in its outer end thereby defining a pair of extension portions 112 which are disposed to overlie the respective cross-wise extending grate member 18. Member 52 on the other end of the outer frame 42 has its outer end notched on both sides, as illustrated at 114, to define a narrowed portion or tongue 116 which is disposed to overlie the respective cross-wise extending grate member 18. The tongue 116 is sized to mate with or fit in groove 110 of a like insert. Thus, referring to FIG. 4, this allows a plurality of inserts 40 to be successively placed in successive grate pockets 30 in series, i.e., end-to-end, with the tongue 116 received in the groove 110 of the successive insert with both the extension portions 112 and the mating tongue 116 overlying the same grate cross member 18. Each of the tongue 116 and extension portions 112 is beveled, as illustrated at 118, to effect a ramp extending upwardly from the respective terminal end thereof to eliminate a "catch point" for the plates 94 being transferred.

Figure 5:
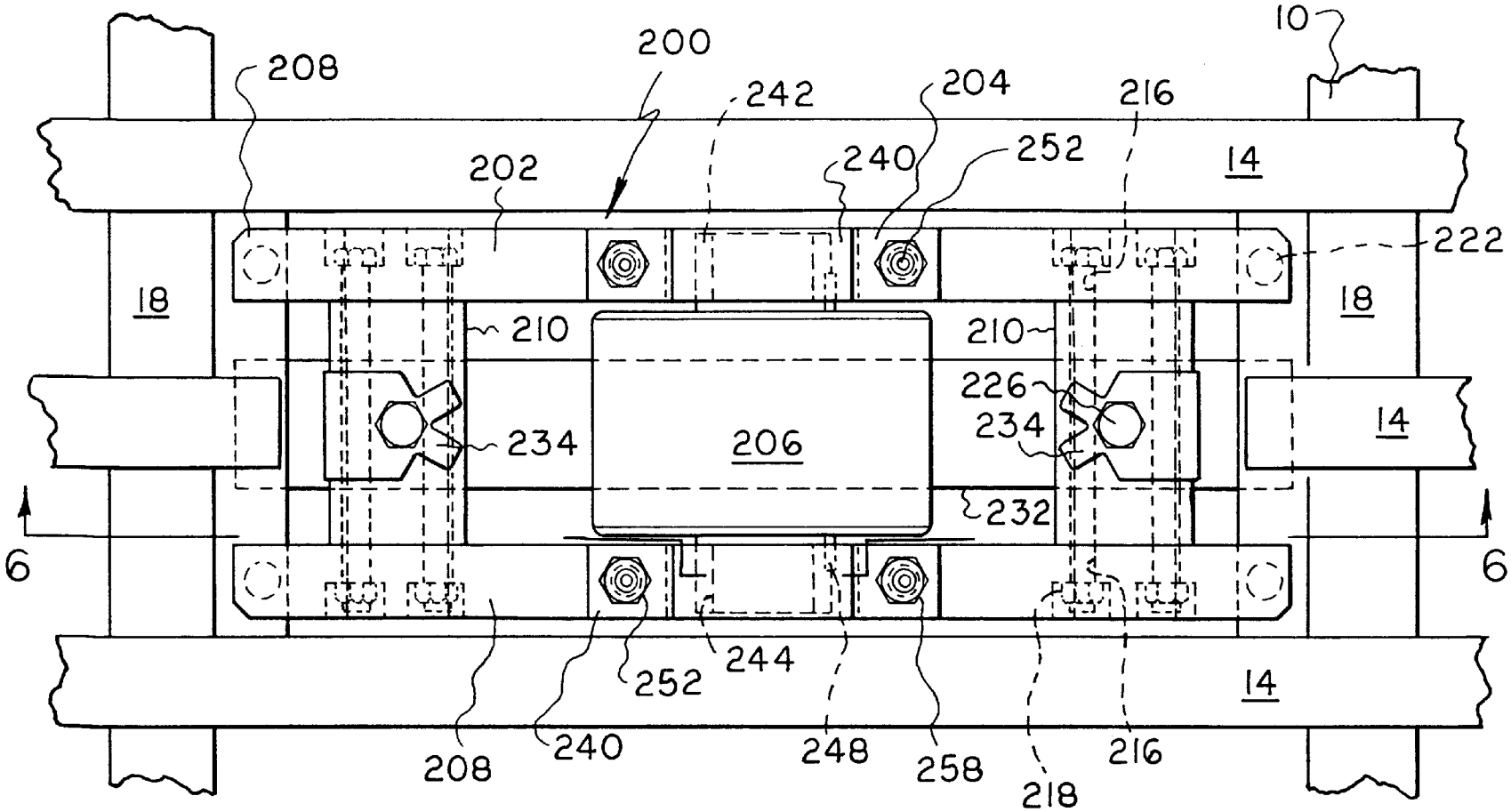
FIG. 5 is a view similar to that of FIG. 1 of an insert in accordance with an alternative embodiment of the present invention.
Figure 6:
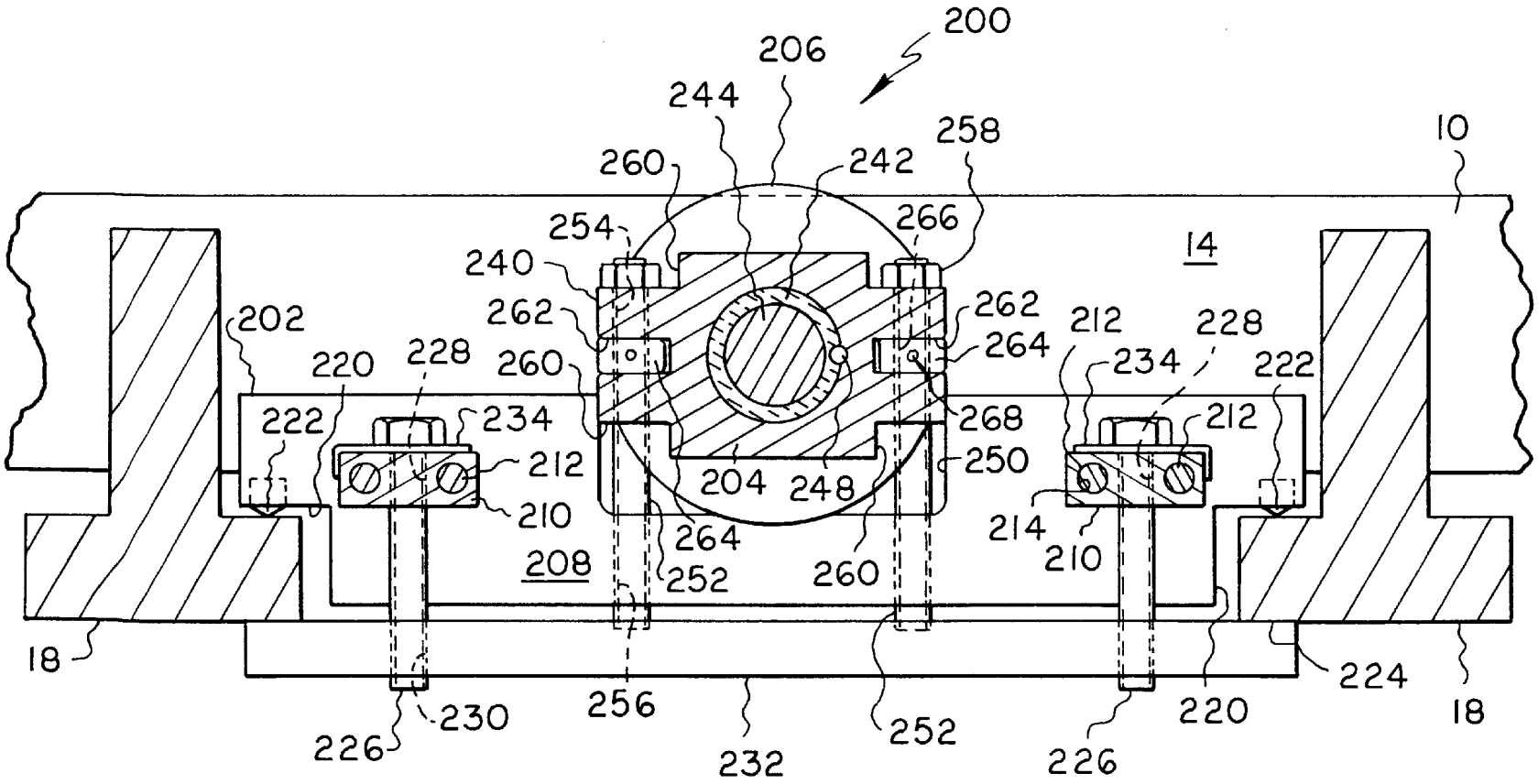
FIG. 6 is a sectional view thereof taken along lines 6—6 of FIG. 5.

Referring to FIGS. 5 and 6, there is illustrated generally at 200 an insert in accordance with an alternative embodiment of the present invention. A segment of one of the members 14 is removed between adjacent cross-members 18 so that the insert 200 is of double width, as discussed in my U.S. patent application Ser. No. 08/768,712, filed Dec. 18, 1996, which application is hereby incorporated by reference.

The insert 200 includes a first or outer frame 202 which is clamped to the grid 10 as described hereinafter and a second or inner frame 204 which supports a roller 206 and which is clamped to the first frame 202 as also described hereinafter.

The first frame 202 includes a pair of elongate parallel plates 208 which are oriented parallel to the grid members 14 when the insert is installed in the pocket. A pair of forward and after plates 210 extend between the plates 208. Each plate 210 is attached thereto by a pair of screws 212 each of which is received in an aperture 214 in the plate 210 and aligned apertures 216 in the plates 208 and threadedly receives a nut 218. The apertures 216 are counter-sunk to receive the screw head and nut 218 respectively so that they are not exposed to the passage of hot plates along the grid. The plates 210 may be otherwise suitably attached to plates 208 such as, for example, by welding.

Each plate 208 is notched in its lower surface at each end, as illustrated at 220. A suitable support button 222 is provided at each end in the notch for locating the insert position, each button 222 resting on the respective lower flange 224 of the respective cross-member 18. A clamping screw 226 is received in an aperture 228 in each plate 210, centrally thereof, and threadedly engages a threaded aperture 230 in a clamp bar 232. The clamp bar 232 extends parallel to members 14, and its ends engage the under-surfaces of flanges 224 respectively. The screws 226 may then be tightened to squeeze the respective flanges between locater buttons 222 and the respective clamp bar ends thereby clamping the frame 202 to the grid 10. A locking tab washer 234 is provided on each clamping screw 226 and is suitably tack-welded or formed/bent to the respective plate 210 to prevent the screw 226 from working loose over time. It should be understood that the outer frame 202 may be otherwise suitably clamped, such as by two clamps, one at each end extending cross-wise to underlie members 14. If desired, the support buttons 222 may be provided to be adjustable from above to allow for uneven castings.

The second frame 204 comprises a pair of blocks 240 each housing a suitable high temperature bearing 242 such as, for example, a bearing marketed by Deva Engineered Bearings, Inc. of Canton, Ohio. The bearings 242 rotatably receive shaft portions 244 which may be integral with or manufactured as a unit with the roller 206. Alternatively, the shaft may be a separate member on which the roller is mounted, similarly as shown in FIGS. 1 to 4 for roller 45 and shaft 88. Anti-rotation pins 248 are provided to prevent rotation between the bearings and the respective blocks. The roller 206 may alternatively have a bearing for rotation about a fixed (not rotatable) shaft.

Each of the plates 208 has a centrally disposed cut-out, illustrated at 250, in its upper surface for receiving and locating the respective bearing block 240. Each bearing block 240 is adjustably mounted to the respective plate 208 by suitable means such as, for example, a pair of forward and aft allen head adjusting screws 252 which are receivable in respective apertures 254 in the block 240 and are threadedly receivable in respective threaded apertures 256 in the respective plates 208. The screws 252 may thus be manipulated to adjust the second frame 204 vertically relative to the first frame 202 after which the screws 252 may be secured in position by lock nuts 258.

The second frame 204 is shown with the bearing blocks 240 being invertible to provide longer bearing life. Accordingly, both the bottom and lower surfaces of each bearing block 240 at each end thereof are suitably provided with notches, illustrated at 260, for receiving the lock nuts 258 respectively.

Another notch 262 is provided in each of the forward and aft surfaces of each block 240 in which is receivable a nut 264. The nut 264 has a threaded aperture 266 in which is threadedly receivable the respective screw 252. The nut 264 and screw 252 have alignable apertures for receiving a pin 268 to prevent relative rotation between the nut and screw 252 and thereby prevent rotation of the screw 252 and nut 264 and a resulting change in height adjustment. Thus, the second frame 204 may be locked at the desired height by insertion of the pins 268 and application of the lock nut 258.

To install all of the inserts so that the rollers are exactly at the same height is very difficult. Furthermore, during operation, the inserts may be caused to move due to impacts. It is however considered desirable to have the rollers contact the plate material in a uniform manner so as to support it to effect transport across the cooling bed with the plate material being maintained flat and without excess pressure being applied to portions of the plate material during roller contact, i.e., it is considered desirable that each of the rollers underlying a plate bear its share of the load. In order to provide flexibility vertically of the rollers to achieve the desired uniformity, in accordance with a preferred embodiment of the present invention, a suitable spring means is provided for supporting the rollers. Three alternative embodiments of the insert incorporating such a spring means are illustrated in FIGS. 7, 8, and 9 and discussed hereinafter.

Figure 7:
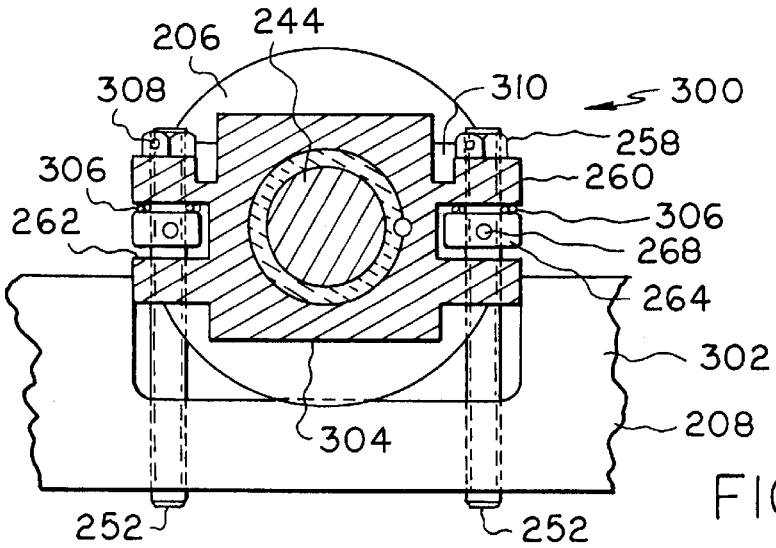
FIGS. 7 and 8 are partial views similar to that of FIG. 6 of inserts in accordance with other alternative embodiments of the present invention.

Referring to FIG. 7, there is shown generally at 300 a portion of an insert having a first or outer frame 302 which is similar to first frame 202 of insert 200 and having a second or inner frame 304 which is similar to second frame 204 of insert 200, except as described hereinafter. In order to maintain the roller 206 biased to a desired unloaded height (i.e., the height when not being pushed downwardly by a plate or the like) but to allow flexibility of some downward movement of the roller so that all of the insert rollers underlying a plate will bear their shares respectively of the load, a suitable spring, illustrated at 306, is disposed about each screw 252 between the upper surface of the nut 264 and the upper surface of the notch 262. A suitable cross pin 308 is provided to retain each nut 258 on the screw 252, and a suitable locking pin, illustrated at 310, is provided for preventing rotation of each screw 252 so that the desired unloaded roller height is maintained while allowing flexibility of limited vertical movement of the roller when subjected to a load of a plate being moved over the grid.

Figure 8:
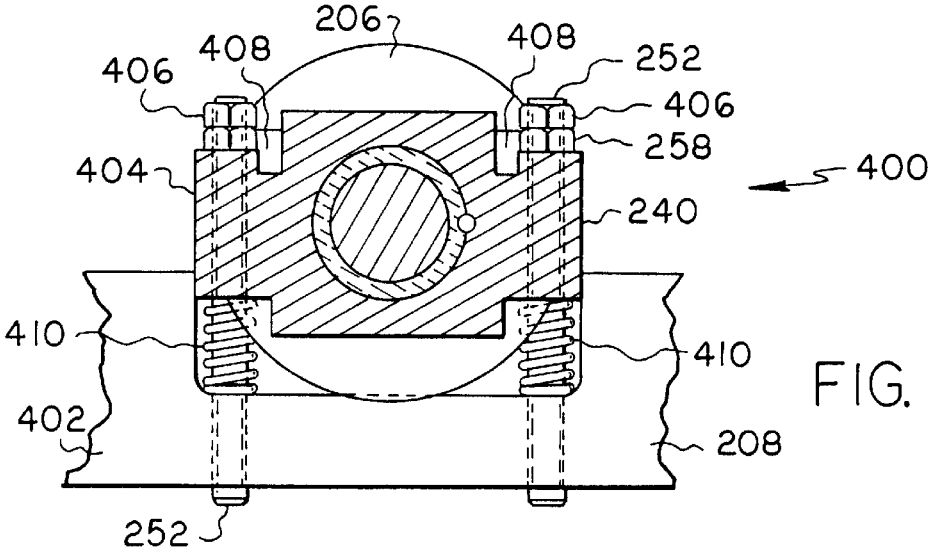

Referring to FIG. 8, there is shown generally at 400 a portion of an insert in accordance with an alternative embodiment of the present invention. The insert 400 has a first or outer frame 402 which is similar to first frame 202 of insert 200 and a second or inner frame 404 which is similar to second frame 204 of insert 200, except as described hereinafter. In accordance with this embodiment, the inner frame 404 does not have a notch or nut or pin corresponding to the notch 262, nut 264, or pin 268 of the insert 200. In order to maintain a desired unloaded roller height, a lock nut 406 is provided on each screw 252 for jam locking thereof in place. A suitable locking pin 408 is provided for each screw 252 to prevent screw rotation so that the desired unloaded roller height is maintained. In order to allow flexibility of movement downwardly of the roller so that each of the rollers underlying a plate will bear its share of the load, a suitable coil compression spring, illustrated at 410, is provided about each screw 252 between the bearing block 240 and the plate 208.

Figure 9:
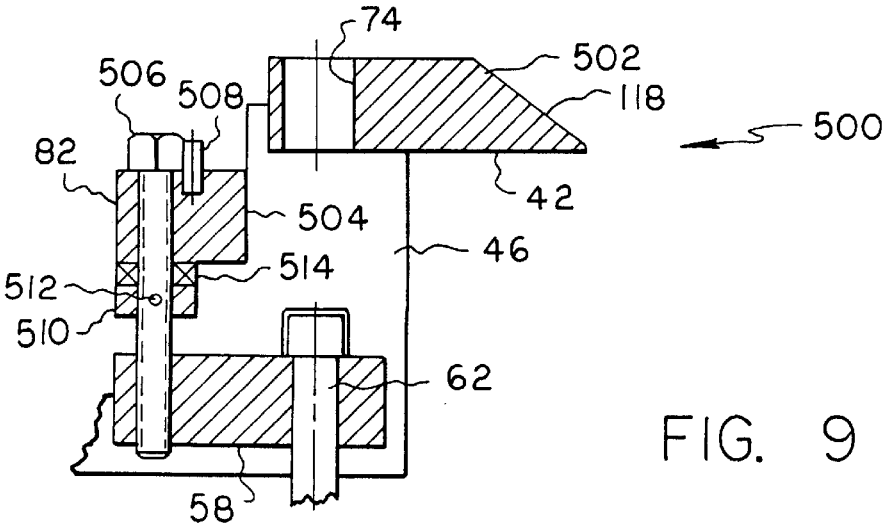
FIG. 9 is a partial view similar to that of FIG. 2 of an insert in accordance with another embodiment of the present invention.

Referring to FIG. 9, there is shown generally at 500 a portion of an insert having a first or outer frame 502 which is similar to first frame 42 of insert 40 and having a second or inner frame 504 including a roller (not shown in FIG. 9) which are similar to second frame 44 and roller 45 of insert 40, except as described hereinafter. In accordance with this embodiment of the present invention, the insert 500 does not have set screws corresponding to set screws 100 of insert 40. Insert 500 has a hex head bolt 506 corresponding to each screw 102 of insert 40, and a suitable locking pin, illustrated at 508, is provided to engage the hex head and prevent the bolt 506 from rotating so that the desired unloaded roller height may be maintained. A collar 510 threadedly engages each bolt 506 and is disposed thereon to be positioned between the respective member 82 and respective frame member 58. A pin, illustrated at 512, engages the collar 510 and bolt 506 to maintain the collar position. A suitable compression spring, illustrated at 514, is disposed about the shank of bolt 506 between the upper surface of collar 510 and the lower surface of member 82 to allow flexibility of movement downwardly of the roller so that each of the rollers underlying a plate bears its share of the load while the unloaded roller height is maintained.

Thus, the insert 40 is provided, in accordance with the present invention, to be rugged and reliable and to be easily, quickly, and inexpensively repairable while easily allowing height adjustment without disturbing its mounting to the grate. Furthermore, the rollers are preferably provided with flexibility of movement downwardly so that each roller underlying a plate may bear its share of the load to thereby protect the plates from damage due to undue stresses thereon.

It should be understood that, while the present invention has been described in detail herein, the invention can be embodied otherwise without departing from the principles thereof, and such other embodiments are meant to come within the scope of the present invention as defined by the appended claims.

What is claimed is:

1. An insert for a cooling bed plate transfer grid having a plurality of elongate parallel first members and a plurality of elongate second members extending crosswise to the first members and defining pockets therewith, the insert comprising a first frame, means for clamping said first frame to the transfer grid to lie within one of the pockets, a second frame, a roller rotatably mounted to said second frame, and means for adjusting the height of said second frame relative to said first frame, said height adjusting means including a plurality of adjusting screws and means for threadedly attaching said adjusting screws to one of said first and second frames to extend therefrom for engaging an other of said first and second frames whereby the distance between said first and second frames is adjustable by manipulating said adjusting screws, and means for clamping said second frame to said first frame when the distance between said first and second frames is at an adjusted distance.

2. An inset according to claim 1 further comprising a shaft on which said roller is mounted and a pair of bearing means in said second frame for rotatably receiving end portions respectively of said shaft.

3. An insert according to claim 1 wherein said second frame has means defining a ramp for deflecting plates onto said roller.

4. An insert according to claim 1 wherein said first frame has means defining beveled end portions for deflecting plates onto said roller.

5. An insert according to claim 1 further comprising means for flexibly allowing movement of said roller vertically.

6. An insert according to claim 1 wherein said threadedly attaching means comprises means for threadedly attaching said adjusting screws to said second frame.

7. An insert according to claim 1 wherein said first frame has first and second end portions which are adapted to overlie successive ones of said second transfer grid members respectively, said first and second end portions having means defining mating tongue portions and grooves respectively whereby two of the insert are mountable to the transfer grid in end-to-end relation with said first end portion of one insert and said second end portion of an other insert overlying the same second transfer grid member.

8. An insert for a cooling bed plate transfer grid having a plurality of elongate parallel first members and a plurality of elongate second members extending crosswise to the first members and defining pockets therewith, the insert comprising a first frame, means for clamping said first frame to the transfer grid to lie within one of the pockets, a second frame, means for clamping said second frame to said first frame, a roller rotatable mounted to said second frame, and means for adjusting the height of said second frame relative to said first frame, said first frame having first and second end portions which are adapted to overlie successive ones of said second transfer grid members respectively, and said first and second end portions having means defining mating tongue portions and grooves respectively whereby two of the insert are mountable to the transfer grid in end-to-end relation with said first end portion of one insert and said second end portion of an other insert overlying the same second transfer grid member.

9. An insert according to claim 8 further comprising a shaft on which said roller is mounted and a pair of bearing means in said second frame for rotatably receiving end portions respectively of said shaft.

10. An insert according to claim 8 wherein said second frame has means defining a ramp for deflecting plates onto said roller.

11. An insert according to claim 8 wherein said first frame has means defining beveled end portions for deflecting plates onto said roller.

12. An insert according to claim 8 further comprising means for flexibly allowing movement of said roller vertically.

13. A method for cooling hot metal plates formed in a plate mill comprising the steps of:

a. providing a cooling bed plate transfer grid having a plurality of elongate parallel first members and a plurality of elongate second members extending crosswise to the first members for support thereof and defining therewith a plurality of pockets;

b. clamping to the transfer grid a plurality of first frames of an insert in a plurality of the pockets respectively;

c. mounting a plurality of second frames having rollers to the plurality of first frames respectively;

d. adjusting the heights of the second frames relative to the first frames respectively;

e. positioning the metal plates on the transfer grid; and f. moving the plates along the transfer grid with the rollers engaging the plates.

14. A method according to claim 13 further comprising removing and replacing the respective second frame and roller to repair an insert.

15. A method according to claim 13 further comprising deflecting the plates to move along ramps on the second frames to the rollers.

16. A method according to claim 13 further comprising deflecting the plates to move along beveled and portions on the first frames onto the insert.

17. A method according to claim 13 further comprising clamping at least some of the inserts to the transfer grid in end-to-end relation with end portions of at least one pair of successive inserts overlying a second grid member in a tongue and groove arrangement.

18. A method according to claim 13 further comprising flexibly moving at least one of the rollers downwardly so that each of the rollers underlying a plate bears its share of the load.

19. In combination with a cooling bed plate transfer grid having a plurality of elongate parallel first members and a plurality of elongate second members extending crosswise to the first members and defining pockets therewith, an insert comprising a first frame, means for clamping said first frame to the transfer grid to lie within one of the pockets, a second frame, a roller rotatably mounted to said second frame, means for adjusting the height of said second frame relative to said first frame, said height adjusting means including a plurality of adjusting screws and means for threadedly attaching said adjusting screws to one of said first and second frames to extend therefrom for engaging an other of said first and second frames whereby the distance between said first and second frames is adjustable by manipulating said adjusting screws, and means for clamping said second frame to said first frame when the distance between said first and second frames is at an adjusted distance.

20. A combination according to claim 19 wherein said threadedly attaching means comprises means for threadedly attaching said adjusting screws to said second frame.

* * * * *